US012760627B2

(12) United States Patent
Zhong et al.

(10) Patent No.: US 12,760,627 B2
(45) Date of Patent: Oct. 13, 2026

(54) DISCRETE CONE FOR EXPANDABLE LINER HANGER IN CASINGS WITH RESTRICTIONS

(71) Applicant: Halliburton Energy Services, Inc., Houston, TX (US)

(72) Inventors: Xiaoguang Allan Zhong, Singapore (SG); Yian Zhao, Singapore (SG); Vern Szen Tan, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/922,034

(22) Filed: Oct. 21, 2024

(65) Prior Publication Data

US 2026/0110238 A1 Apr. 23, 2026

(51) Int. Cl.
*E21B 43/10* (2006.01)

(52) U.S. Cl.
CPC ..... *E21B 43/105* (2013.01)

(58) Field of Classification Search
CPC ..... E21B 43/10; E21B 43/105; E21B 43/103
See application file for complete search history.

(56) References Cited

U.S. PATENT DOCUMENTS

| | | | | |
|---|---|---|---|---|
| 7,117,941 | B1 | 10/2006 | Gano et al. | |
| 9,938,787 | B2 | 4/2018 | Zakharia et al. | |
| 10,151,168 | B2 | 12/2018 | Hallundbaek et al. | |
| 11,802,464 | B2 | 10/2023 | Williams | |
| 2003/0111234 | A1* | 6/2003 | McClurkin | E21B 43/105 166/380 |
| 2008/0223568 | A1 | 9/2008 | Roggeband et al. | |
| 2012/0222868 | A1 | 9/2012 | Hazelip | |
| 2013/0299197 | A1* | 11/2013 | Bennett | E21B 43/105 166/207 |
| 2014/0209325 | A1* | 7/2014 | Dockweiler | E21B 23/01 166/217 |
| 2018/0187527 | A1 | 7/2018 | Bouma | |
| 2019/0040721 | A1 | 2/2019 | Kohn et al. | |
| 2019/0316448 | A1* | 10/2019 | Connor | E21B 33/14 |
| 2020/0040684 | A1 | 2/2020 | Andersen et al. | |
| 2024/0151123 | A1 | 5/2024 | Loh et al. | |
| 2025/0059857 | A1 | 2/2025 | Fripp et al. | |

FOREIGN PATENT DOCUMENTS

| | | | | |
|---|---|---|---|---|
| CA | 2816173 | A1 * | 11/2013 | E21B 43/105 |

OTHER PUBLICATIONS

"PCT/US2024/054308 International Search Report and Written Opinion", Jul. 11, 2025, 10 pages.
"U.S. Appl. No. 19/347,803 Non-Final Office Action", Apr. 22, 2026, 11 pages.

* cited by examiner

*Primary Examiner* — Caroline N Butcher
(74) *Attorney, Agent, or Firm* — DeLizio, Peacock, Lewin and Guerra, LLP

(57) ABSTRACT

An apparatus for expanding an expandable liner hanger. The apparatus comprises a variable cone comprising one or more wedge segments and one or more circular segments, wherein the one or more wedge segments and the one or more circular segments are configured to radially expand or contract when axially translated along a tapered mandrel.

20 Claims, 5 Drawing Sheets

DISCRETE CONE FOR EXPANDABLE LINER HANGER IN CASINGS WITH RESTRICTIONS

TECHNICAL FIELD

This disclosure relates generally to the field of hydrocarbon recovery operations and more particular to expandable liner hangers.

BACKGROUND

In the construction of wellbores formed in the Earth's subsurface, casing is positioned and cemented in the wellbore for a plurality of reasons such as isolation from the rock and fluids in the surrounding formation, wellbore stability, etc. A string of casing may extend from the bottom of the wellbore to the surface. In some implementations, a liner may be positioned in wellbore. A liner may be a string of casing that does not extend to the surface, but is instead anchored or suspended inside an existing casing string in the wellbore to extend the cased section of the wellbore beyond the cemented casing section. For example, a casing string may be anchored at the surface and cover the vertical section of a wellbore. A liner hanger may be anchored near the end of the casing string and cover the remaining lower sections of the wellbore (such as the curve and lateral sections). A liner may be utilized to reduce the number of total joints used in the wellbore, resulting in cost savings. The liner may be anchored/suspended inside a casing string with a liner hanger, such as an expandable liner hanger. The expandable liner hanger may be configured with one or more expandable mechanisms that, when activated, increase in diameter to press tightly against the inside of the casing or the wellbore to provide a solid anchoring point. The expandable liner hanger may be expanded by a cone that is inserted through the expandable mechanism.

BRIEF DESCRIPTION OF THE DRAWINGS

Implementations of the disclosure may be better understood by referencing the accompanying drawings.

DESCRIPTION

Figure 1:
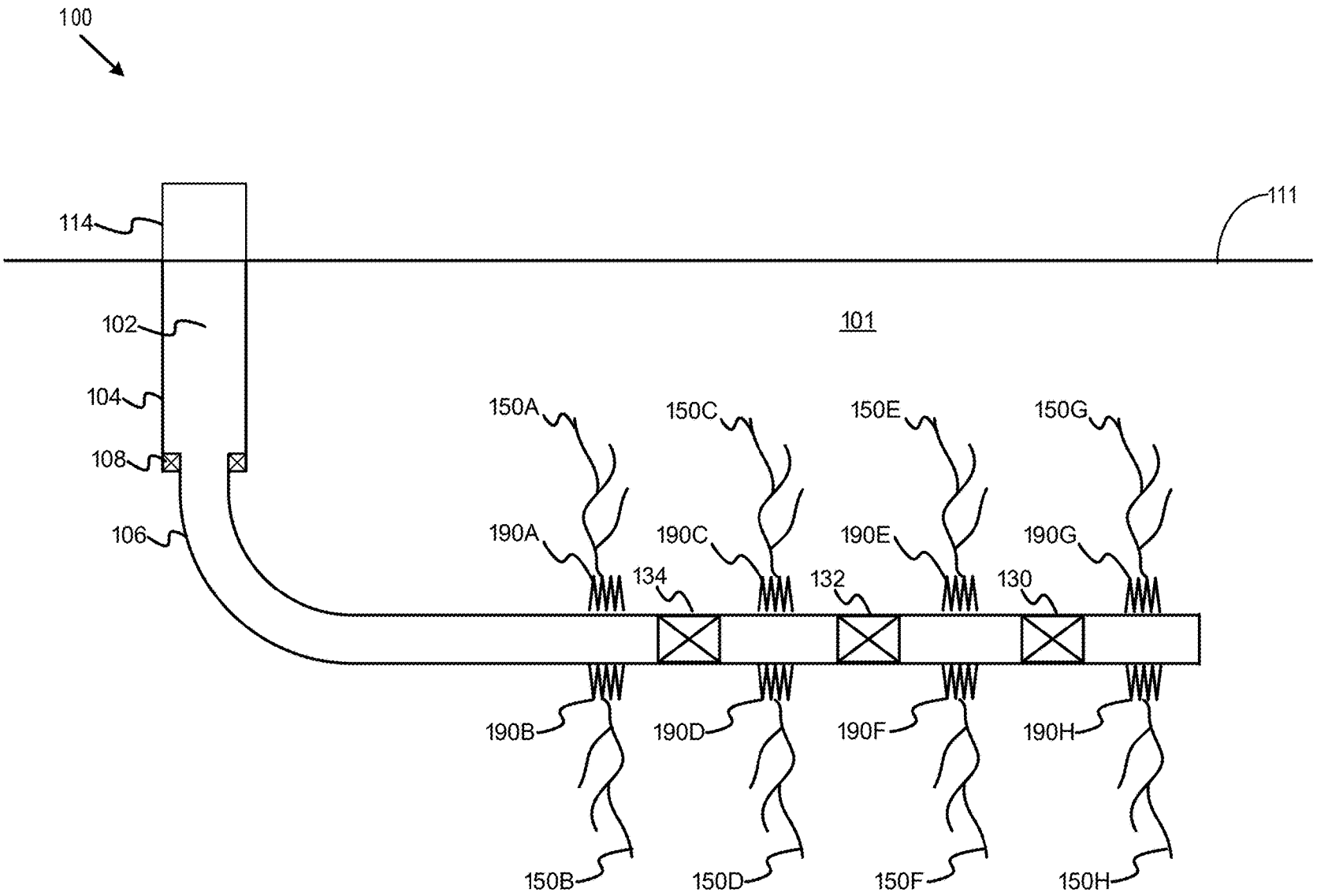
FIG. 1 is an illustration depicting an example well system, according to some implementations.

The description that follows includes example systems, methods, techniques, and program flows that embody aspects of the disclosure. However, it is understood that this disclosure may be practiced without these specific details. For instance, this disclosure refers to configurations of wedge segments and circular segments. Aspects of this disclosure can also be applied to any other configuration of wedge segments and circular segments. For clarity, some well-known instruction instances, protocols, structures, and operations have been omitted.

Example implementations relate to a variable cone configured to be expanded by a tapered mandrel when at a location of expansion in a wellbore, such as to expand an expandable liner hanger. Expandable liner hangers (ELH) typically expand with a solid cone so that the hanger can be expanded and engaged with the surrounding casing. In some applications, such as in big bore casing (e.g., 16 inch diameter casing, 18 inch diameter casing, 20 inch diameter casing, 22 inch diameter casing, etc.), casing restrictions (such as casing collars, profile nipples, etc.) may limit the cone outer diameter (OD) size. Thus, when the cone expands the ELH, the ELH may not fully expand to the casing and be able to engage with casing for a reasonable anchor load capacity. In conventional applications, a variable cone design may utilize a fixed cone combined with a segmented variable cone which may be expanded and supported by a wedge. However, the segmented cone must leave multiple slots when in the expansion state which could impair the performance of the variable cone compared to a solid cone design. In some instances, the issues may become more significant when the cone is required to have a large variation (due to differences in casing restriction ODs and the ELH expansion OD) as it may result in more segments and/or larger slots (i.e., more potential failure points). Additionally, or alternatively, the variable cone design may be prone to getting stuck when expanding or when being removed from the ELH.

In some implementations, a discrete cone design may be configured to address casing restrictions and also achieve desired ELH expansion outcome. A cone system may include a variable cone comprising one or more wedge segments and one or more circular segments. The wedge segments and circular segments may be alternated in a circular pattern and configured to radially expand and contract. The variable cone may comprise three wedge segments and three circular segments (6 total segments) in an alternating order in a circular pattern. However, there may be no limit to the number of segments. For example, the variable cone may include more than or less than three of each segment. The cone system may also include a tapered mandrel. The diameter (or width, if not circular) of the tapered mandrel may increase along an axial direction. For example, the width of the first end of the tapered mandrel may be less than the width of the opposite end of the tapered mandrel. The variable cone (wedge segments and circular segments) may be positioned around the tapered mandrel. When the variable cone is positioned proximate the smaller end of the tapered mandrel (either surrounding the smaller end or next to, but not surrounding, the smaller end), the variable cone may be in the disengaged state. The variable cone may axially translate along the tapered mandrel towards the larger end of the tapered mandrel, and faces of the tapered mandrel may push the respective segments radially outward as they slide on the tapered mandrel to radially expand the variable cone. When at the larger end of the tapered mandrel, the variable cone may be in the assemble state. Thus, the effective outer diameter (OD) of the variable cone is greater in the assembled state than the effective OD in the disengaged state. When in the assembled state, the variable cone may be a fully seamless cone shape with a desired outer diameter for expanding an ELH. In some implementations, the segments and/or tapered mandrel may be configured with components (such as channels/slots and channel/slot inserts) such that each segment maintains a respective circumferential position on the tapered mandrel.

The cone system may be deployed into a wellbore in a disengaged state, allowing the cone system to fit through any casing restrictions. In some implementations, the cone system may include one or more bias components (such as axial springs, shear pins, etc.) or other suitable components (such as elastic retainers) to keep the variable cone in the disengaged state and prevent the segments from translating along the tapered mandrel. When the cone system reaches the location of expansion (i.e., a hanger launching region/the expansion mechanism of the ELH), force may be applied to either the variable cone and/or the tapered mandrel such that the variable cone axially translates along the tapered mandrel and the variable cone may radially expand to the assembled state. The relative movement between the variable cone and tapered mandrel may occur when the segments are contacting the ELH launching region. In some implementations, the cone system may include a solid cone which may contact the ELH launching region and thus apply force to the variable cone for assembly. The force required for assembly may be provided through the expansion force or other mechanisms (such as hydraulic pressure applied directly and/or indirectly through a piton rod). Once in the assembled state, the variable cone may function just like a conventional solid cone in the ELH expansion process. The variable cone may be lowered through the ELH, expanding the ELH to anchor the ELH/liner hanger in place. After the ELH has been expanded, the cone system may be removed from the ELH, and the variable cone may contract, returning to the disengaged state so that the force during pullout is avoided and the cone system can fit through any casing restrictions it encountered when being deployed in the wellbore.

Example System

FIG. 1 is an illustration depicting an example well system, according to some implementations. In particular, FIG. 1 is a schematic of a well system 100 that includes a wellbore 102 in a subsurface formation 101. The wellbore 102 includes casing 104 coupled with a wellhead 114 at the surface and a liner 106 anchored to the casing 104 via a liner hanger 108. In some implementations, the liner hanger 108 may be an expandable liner hanger (ELH) that is expanded to engage with the casing 104. The liner hanger 108 may be expanded with a cone system (not pictured). The cone system comprising a variable cone and a tapered mandrel may be deployed in the wellbore 102 and positioned in the liner hanger 108 to expand and set the liner hanger 108. Once the liner hanger 108 is set, the discrete cone system may be removed from the wellbore 102.

A number of perforations 190A-190H being made in the liner 106 at different depths to allow reservoir fluids (i.e., oil, water, and gas) from the subsurface formation 101 to flow into the wellbore 102. During hydraulic fracturing operations of the wellbores 102, fracturing fluid, with or without sand, may be pumped into the subsurface formation 101, via the perforations 190A-190H, to generate fractures 150A-150H in the subsurface formation such that reservoir fluid may flow into the wellbore 102. In some implementations, the wellbore 102 may be hydraulically fractured in stages. For example, a first stage may include hydraulically fracturing the perforations 190G, 190H to generate fractures 150G, 150H, respectively. After the hydraulic fracturing operations for the first stage are complete, a frac plug 130 may be positioned in the liner 106 above the first stage (i.e., at a lesser depth in the wellbore than perforations 190G, 190H). The frac plug 130 may be positioned in the wellbore 102 via any suitable setting method such as wireline. Once the frac plug 130 is positioned in the liner 106, the perforations 190E, 190F may be formed in the liner 106 and hydraulic fracturing operations may commence for the next stage. Similar operations may be repeated for each subsequent stage (i.e., setting frac plug 132 and frac plug 134 and hydraulically fracturing the next subsequent stage) until hydraulic fracturing operations for the wellbore 102 are complete.

Example Cone Systems

Example configurations of a cone system are now described.

Figure 2B:
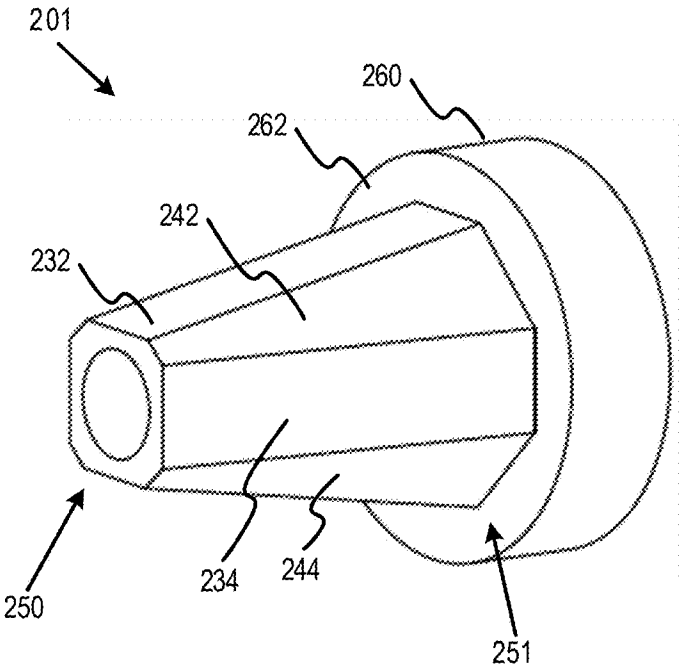
FIGS. 2A-2B are schematics depicting example cone system components, according to some implementations.
Figure 2A:
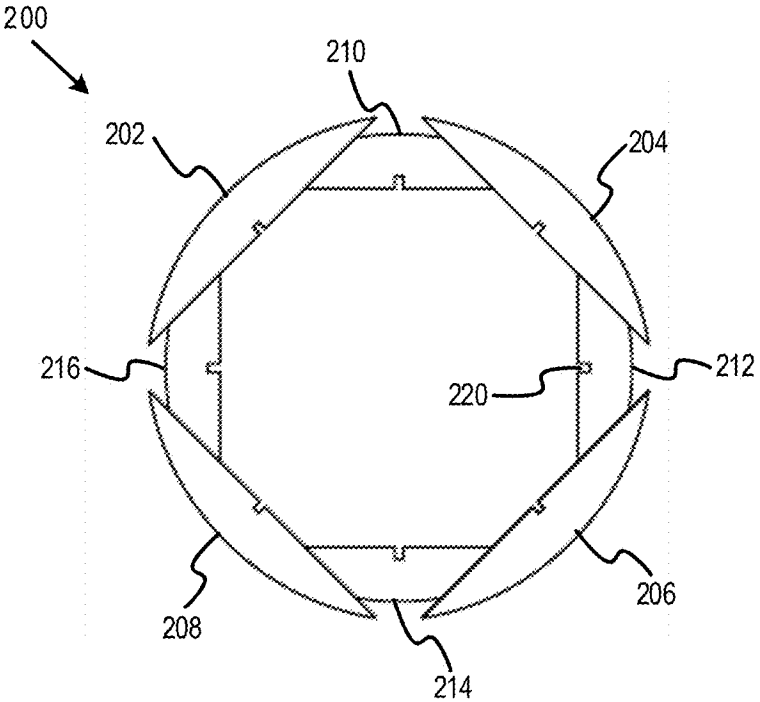

FIGS. 2A-2B are schematics depicting example cone system components, according to some implementations. In particular, FIG. 2A includes a schematic of a variable cone 200 and FIG. 2B includes a schematic of a tapered mandrel 201. The variable cone 200 is configured with wedge segments 210-216 positioned between circular segments 202-208. The segments (wedge segments 210-216 and circular segments 202-208) may be configured in a circular pattern, alternating between wedge segments and circular segments. FIG. 2A depicts a variable cone 200 with 4 pairs of segments (4 wedge segments 210-216 and 4 circular segments 202-208) for descriptive purposes. The variable cone 200 is not limited to 4 pairs of segments, and may be configured with more or less than 4 pairs of segments. The variable cone 200 depicts the wedge segments 210-216 with a length less than the circular segments 202-208. In some implementations, the lengths of the wedge segments 210-216 may be equal to and/or greater than the circular segments 202-208.

The tapered mandrel 201 includes a first end 250 and a second end 251 with a flange 260 at the end of the second end 251, where the first end 250 has a width that is less than the width of the second end 251. The width of the tapered mandrel 201 increases axially from the first end 250 to the second end 251. The first end 250 of the tapered mandrel 201 may be inserted in the variable cone 200 such that the segments of the variable cone 200 surround the tapered mandrel 201. The shape of the cross-sectional profile of the tapered mandrel 201 may be similar to the cross-sectional profile of the inner faces of the segments that make up the variable cone 200. The tapered mandrel 201 may be configured with faces (such as 232, 234, 242, and 244) such that the internal faces of the segments on the variable cone 200 may be in contact with the respective faces. For example, the internal face of the wedge segment 210 may be in contact with the face 232. In some implementations, each of the segments may be configured with a channel (such as channel 220) that may interact with a component (such as an insert, tab, etc.) on a respective face of the tapered mandrel 201 such that the segment may maintain its circumferential position on the tapered mandrel 201. In some implementations, the faces of the tapered mandrel 201 may be configured with the channel 220 and the segments may be configured with the respective compatible component. As the variable cone 200 translates axially along the tapered mandrel 201 from the first end 250 towards the second end 251, the faces of the tapered mandrel 201 may push the respective segments radially outward, expanding the variable cone 200 to expand the effective diameter of the variable cone 200 until the segments are fully expanded to a seamless cone shape with a desired diameter. The desired diameter may be dictated by the length and/or width (diameter) of the tapered mandrel, the thickness and/or shape of the segments, or any combination thereof. When the variable cone 200 translates axially from the second end 251 towards the first end 250, the segments contract and thus the effective diameter of the variable cone 200 decreases. A disengaged and fully assembled cone system is described in FIGS. 3A-3B below.

FIGS. 2A and 2B depict flat inner faces of the segments and flat faces of the tapered mandrel 201, respectively. The inner faces of the segment and respective faces on the tapered mandrel 201 may be any suitable cross-sectional shape, such as non-linear (i.e., arced). The thickness of each segment on the variable cone may be uniform or different. For example, the thickness of one or more wedge segments 210-216 may be greater than the thickness of one or more circular segments 202-208. Accordingly, the profile of the tapered mandrel 201 be configured to account for the profile of the variable cone 200.

Figure 3B:
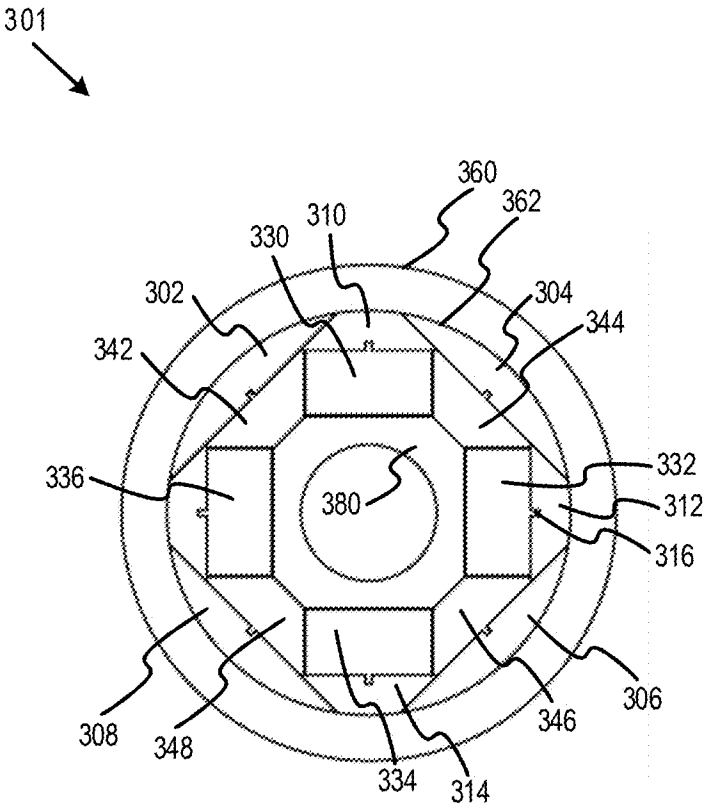
FIGS. 3A-3B are schematics depicting example cone systems, according to some implementations.
Figure 3A:
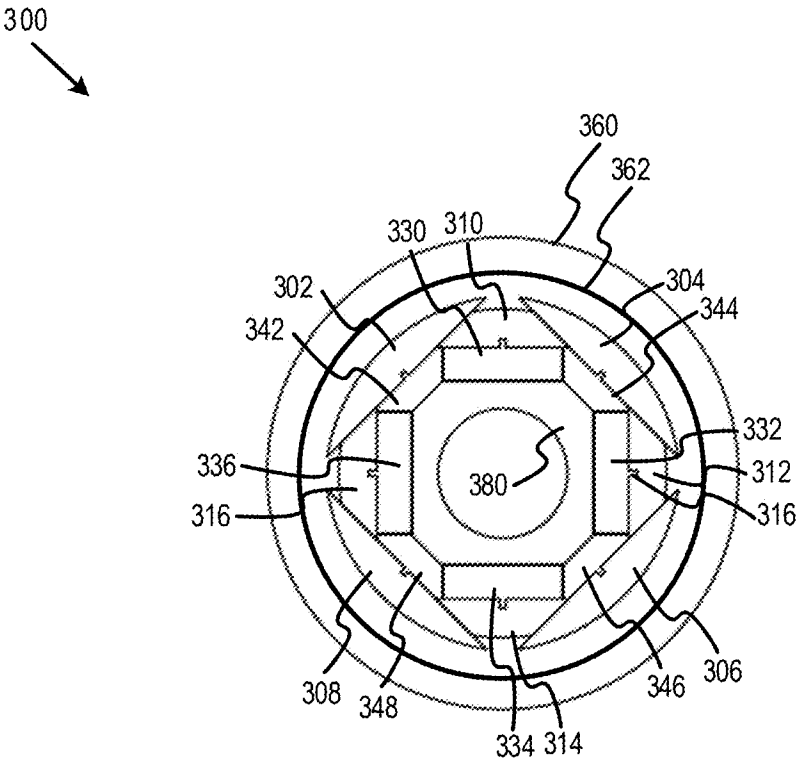

FIGS. 3A-3B are schematics depicting example cone systems, according to some implementations. FIG. 3A includes a cross-sectional schematic of a disengaged cone system 300. A variable cone (similar to the variable cone 200 described in FIG. 2A) may comprise wedge segments 310-316 and circular segments 302-308. The variable cone surrounds a tapered mandrel 310 (similar to the tapered mandrel 201 described in FIG. 2B). The cone system (variable cone and tapered mandrel 310) is positioned inside a pipe 360 (such as an expandable liner hanger). When in a disengaged state, the variable cone is not radially extended to a seamless cone with a desired diameter to contact the inner wall 362 of the pipe 360 (such as the expandable mechanisms of an ELH). Rather, the segments may be positioned at the smaller end of the tapered mandrel 380 (such as the first end 250 of the tapered mandrel 201 described in FIG. 2B) or any other position on the tapered mandrel 380 other than the end with the largest width/diameter when the segments are fully expanded.

FIG. 3B includes a cross-sectional schematic of an assembled cone system 301. When in the assembled state, the segments are fully extended to create a seamless cone that may contact the inner wall 362 of the pipe 360. The variable cone may be in the assembled state when the segments are positioned at the larger end of the tapered mandrel (such as the second end 251 of the tapered mandrel 201 described in FIG. 2B). To transition to the assembled state, the variable cone may axially translate along the tapered mandrel 310 such that faces 330-334 and faces 342-348 may push the wedge segments 310-316 and circular segments 302-308 radially outward, respectively. As previously described, the faces 330-348 on the tapered mandrel and respective segments may be configured with channels and insert components (or any other suitable systems such as tracks, grooves, etc.) to allow the segments to maintain a circumferential position on the tapered mandrel.

Figure 4A:
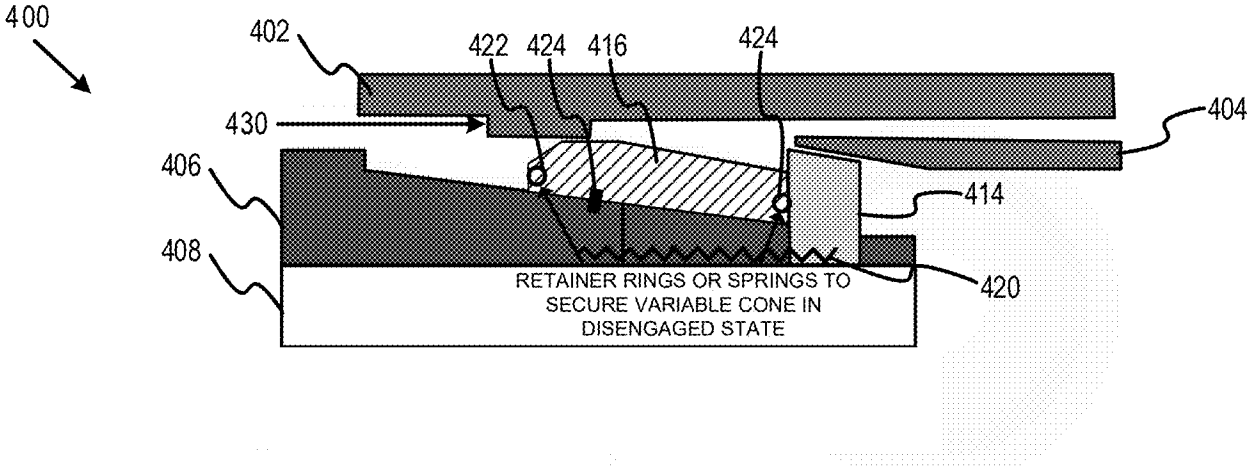
FIGS. 4A-4B are schematics of the assembly of a cone system, according to some implementations.
Figure 4B:
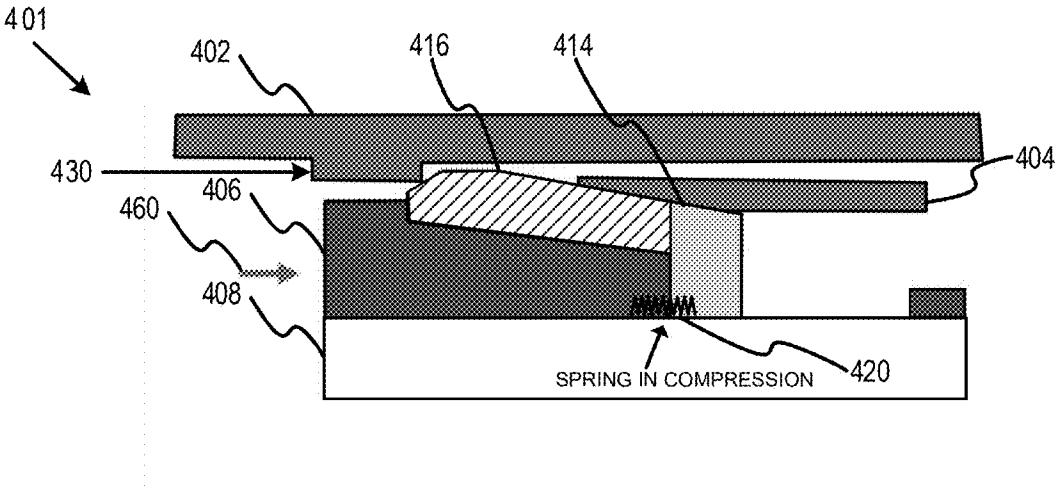

FIGS. 4A-4B are schematics of the assembly of a cone system, according to some implementations. In particular, FIG. 4A includes a side view of a cone system in a disengaged state 400 and FIG. 4B includes a side view of a cone system in an assembled state 401. A cone system comprising a tapered mandrel 406 and a variable cone 416 may be positioned on a tubular 408. The cone system may be in a disengaged state when the variable cone 416 is positioned at the smaller end of the tapered mandrel 406. Accordingly, when the tubular 408 with the cone system is deployed in a wellbore, the effective diameter of the variable cone is reduced relative to when in the assembled state (described below) such that the cone system may be able to pass by any restrictions in the wellbore, such as the restriction 430 (such as a collar, profile nipple, sleeve, etc.) on a casing 402. The cone system may be configured with one or more components such as one or more bias components (such as a spring 420), one or more retainer rings 422, 424 on one or more segments on the variable cone 416, etc. to secure the variable cone in the disengaged state. For example, when the cone system is being deployed in a wellbore, the one or more components may secure the variable cone 416 in place on the tapered mandrel 406 so the variable cone 416 does not axially translate on the tapered mandrel 406 and prematurely expand, resulting in contacting the casing 402 or casing restrictions 430 which may damage the variable cone 416, the casing, and/or other components being deployed in the wellbore. When in the disengaged state, the spring 420 may be in a neutral state or compression state.

The cone system may be deployed in a wellbore to expand an expandable liner hanger 404. To transition to the assembled state 401, the cone assembly may be lowered in the downhole direction and come into contact with an expandable liner hanger 404. In some implementations, the cone system may include a solid cone 414 which may contact the expandable liner hanger 404. When contacting the expandable liner hanger 404, force 460 may be applied to the tapered mandrel 406 (such as through hydraulic pressure), resulting in a reactive force on variable cone 416 by the expandable liner hanger 404 (either directly, or indirectly if the solid cone 414 is present). After the variable cone 416 (or solid cone 414) contacts the expandable liner hanger 404, the force 460 may be continuously applied to the tapered mandrel 406, forcing the tapered mandrel 406 to move in the downhole direction. Accordingly, the variable cone 416 may axially translate along the tapered mandrel 406 as the tapered mandrel 406 moves downhole relative to the variable cone 416, radially expanding the variable cone 416 until the variable cone 416 is expanded to a seamless cone and thus to an assembled state. The axial movement may be limited by a flange (or other profile) on the larger end of the tapered mandrel 406 (such as the flange 260 described in FIG. 2B). The variable cone 416 may then function as a solid cone as it is lowered downhole into the expandable liner hanger 404 to expand the expandable mechanisms of the expandable liner hanger 404 to secure the expandable liner hanger 404 to the casing 402. When lowered into the expandable liner hanger 404, the spring 420 may be compressed. In some implementations, the spring 420 may be in any other suitable position on the cone system, such as in a position where the spring 420 is put into tension when the cone system is expanding the expandable liner hanger 404, and may pull the variable cone 416 (and solid cone 414) when transitioning from the assembled state back to the disengaged state.

Once the expandable liner hanger 404 has been expanded by the variable cone 416 in the assembled state, the cone system may be pulled uphole to remove the tubular 408 and cone system from the wellbore. In some implementations, the force 460 on the cone system may be reduced (such as when hydraulic pressure on the tapered mandrel 406 is reduced after the expandable liner hanger 404 has been set). Once the force 460 is less than the force on the spring 420, the spring 420 may push (or pull if in tension) the tapered mandrel 406 axially away from the variable cone 414 (and solid cone 414) in the opposite direction of when it was being assembled until it returns to its initial position in the disengaged state. When disassembling, the effective diameter of the variable cone is reduced such that the cone system may pass through the restriction 430 when being pulled uphole. Due to the reduction in the effective diameter when the cone system is removed from the expandable liner hanger 404, additional pullout force may be avoided, reducing the risk of damaging or sticking any downhole equipment. In some implementations, when a solid cone 414 is utilized, the solid cone 414 and the variable cone 416 may be made of similar and/or different material because the cone deflection may be avoided during pullout.

In some implementations, the variable cone 416 and the tapered mandrel 406 may be positioned in any other configuration. For example, the tapered mandrel 406 may be positioned downhole on the tubular 408 relative to the variable cone 416. Accordingly, a force may be applied to the tapered mandrel 406 to assemble the variable cone 416. Any suitable configuration of the cone system and/or method for assembling and disassembling the cone system may be utilized for expanding an ELH via the cone system.

Example Operations

Examples operations are now described.

Figure 5:
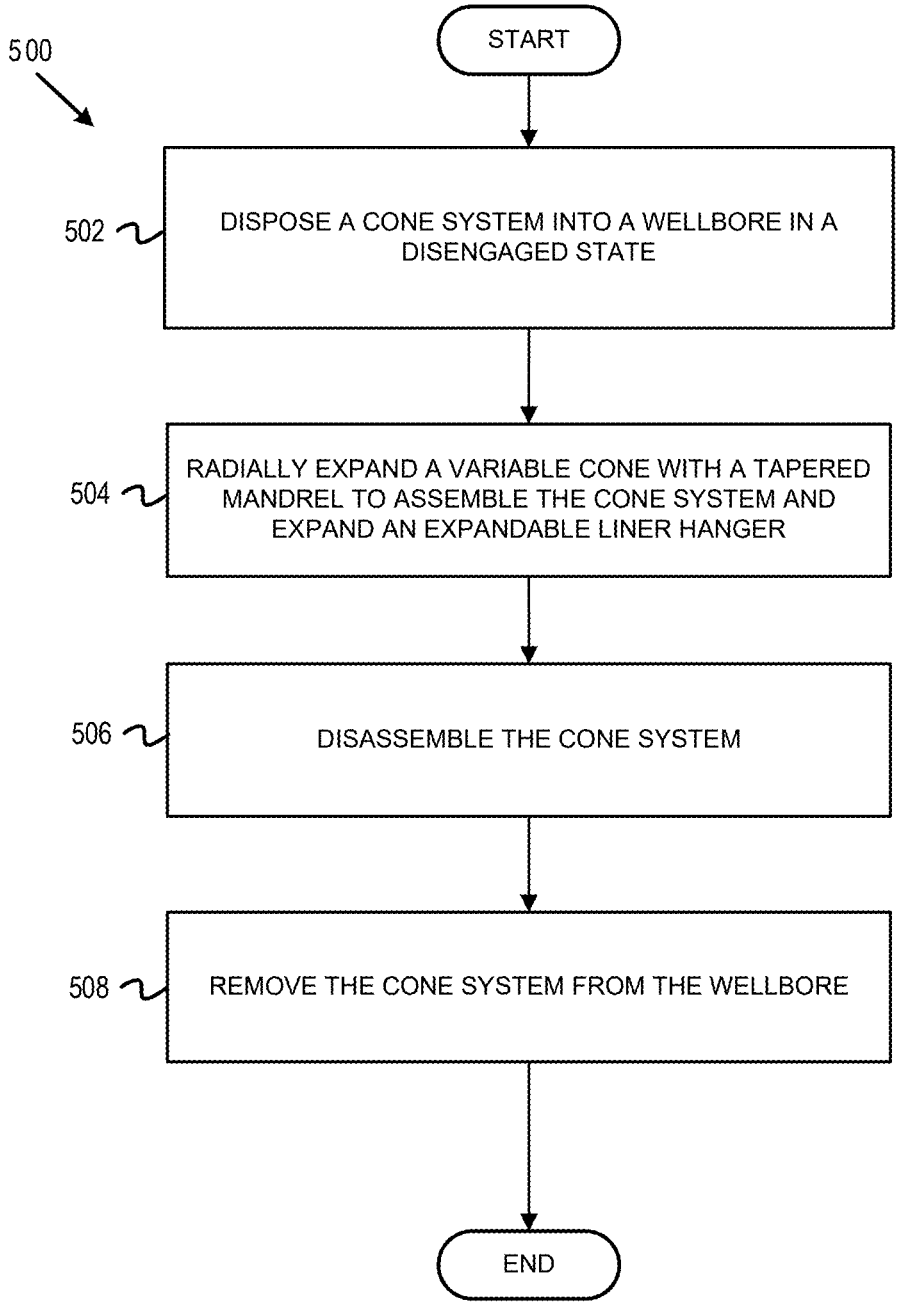
FIG. 5 is a flowchart depicting example operations for expanding an expandable liner hanger via a cone system, according to some implementations.

FIG. 5 is a flowchart depicting example operations for expanding an expandable liner hanger via a cone system, according to some implementations. FIG. 5 depicts a flowchart 500 of operations to dispose a cone system comprising a tapered mandrel and a variable cone in an expandable liner hanger in a wellbore. The operations of flowchart 500 are described in reference to the cone systems described in FIGS. 2-4.

At block 502, a cone system may be disposed into a wellbore in a disengaged state. The cone system may comprise a tapered mandrel and a variable cone (comprising one or more wedge segments and one or more circular segments). The cone system may be disposed via a tubular string, wireline, or any other suitable device(s). The cone system may be positioned in an expandable liner hanger in the wellbore.

At block 504, a variable cone may radially expand with a tapered mandrel to assemble the cone system and expand an expandable liner hanger. A force may be applied to the tapered mandrel so to make variable cone to axially translate along the tapered mandrel to push the segments radially outward to form a seamless cone. Once assembled, the variable cone may function as a solid cone and expand the expanding mechanism of the ELH, allowing the ELH to engage and anchor to the casing.

At block 506, the cone system may be disassembled. After the ELH has been expanded, the force applied to the tapered mandrel may be reduced to transition the variable cone and tapered mandrel to a disengaged state. When disassembled, the variable cone may axially translate along the tapered mandrel in the opposite direction, thus reducing the effective diameter of the variable cone. In some implementations, one or more bias components may force the variable cone to disassemble when force is no longer applied to the variable cone to radially expand. For example, when the tension on the spring is greater than the force being applied to the variable cone (via an ELH, solid cone from the ELH, etc.) the variable cone may axially translate along the tapered mandrel in the direction of the spring force (towards the disengaged state). When disassembled and the variable cone is no longer contacting the ELH, the cone system is returned to the disengaged state.

At block 508, the cone system may be removed from the wellbore.

While the aspects of the disclosure are described with reference to various implementations and exploitations, it will be understood that these aspects are illustrative and that the scope of the claims is not limited to them. In general, techniques for configuring a variable cone and tapered mandrel as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Certain features that are described in this specification in the context of separate implementations also may be implemented in combination in a single implementation. Conversely, various features that are described in the context of a single implementation also may be implemented in multiple implementations separately or in any suitable subcombination. Moreover, although features may be described as acting in certain combinations and even initially claimed as such, one or more features from a claimed combination may in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example process in the form of a flow diagram. However, some operations may be omitted and/or other operations that are not depicted may be incorporated in the example processes that are schematically illustrated. For example, one or more additional operations may be performed before, after, simultaneously, or between any of the illustrated operations. In certain circumstances, multitasking and parallel processing may be advantageous. Moreover, the separation of various system components in the implementations described should not be understood as requiring such separation in all implementations, and the described program components and systems may generally be integrated together in a single software product or packaged into multiple software products. Additionally, other implementations are within the scope of the following claims. In some cases, the actions recited in the claims may be performed in a different order and still achieve desirable results.

Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subsurface formation" shall be construed as encompassing both areas below exposed earth and areas below earth covered by water such as ocean or fresh water.

Example Implementations

Implementation #1: An apparatus for expanding an expandable liner hanger comprising: a variable cone comprising one or more wedge segments and one or more circular segments, wherein the one or more wedge segments and the one or more circular segments are configured to radially expand or contract when axially translated along a tapered mandrel.

Implementation #2: The apparatus of Implementation #1, wherein the one or more wedge segments and the one or more circular segments are configured with one or more channels to maintain a respective circumferential position with respect to the tapered mandrel, and wherein the tapered mandrel includes one or more insert components to fit inside the respective channels.

Implementation #3: The apparatus of Implementation #1 or #2, wherein the tapered mandrel is configured with one or more channels, and wherein the one or more wedge segments and the one or more circular segments are configured with one or more insert components to fit inside the respective channels to maintain a respective circumferential position with respect to the tapered mandrel.

Implementation #4: The apparatus of any one or more of Implementation #1-3, wherein the one or more wedge segments and the one or more circular segments radially expand to an assembled state when the variable cone axially translates along the tapered mandrel in a first direction.

Implementation #5: The apparatus of Implementation #4, wherein the variable cone contacts a hanger launching region of the expandable liner hanger when in the assembled state to expand the expandable liner hanger.

Implementation #6: The apparatus of Implementation #4 or #5, wherein the one or more wedge segments and the one or more circular segments radially contract to a disengaged state when the variable cone axially translates along the tapered mandrel in a second direction that is opposite the first direction.

Implementation #7: The apparatus of Implementation #6 further comprising: one or more bias components to maintain the variable cone in the disengaged state.

Implementation #8: The apparatus of any one or more of Implementation #1-7, wherein the one or more wedge segments and the one or more circular segments are configured in an alternating circular pattern to form the variable cone.

Implementation #9: The apparatus of any one or more of Implementation #1-8 further comprising: a solid cone, wherein the solid cone applies a force to the variable cone to radially expand the variable cone.

Implementation #10: A system comprising: a tapered mandrel; and a variable cone comprising a one or more wedge segments and a one or more circular segments configured to radially expand or contract when axially translated along the tapered mandrel.

Implementation #11: The system of Implementation #10, wherein the one or more wedge segments and the one or more circular segments radially expand to an assembled state when the variable cone axially translates along the tapered mandrel in a first direction.

Implementation #12: The system of any one or more of Implementation #11, wherein the variable cone contacts a hanger launching region of an expandable liner hanger when in the assembled state to expand the expandable liner hanger.

Implementation #13: The system of Implementation #11 or #12, wherein the one or more wedge segments and the one or more circular segments radially contract to a disengaged state when the variable cone axially translates along the tapered mandrel in a second direction that is opposite the first direction.

Implementation #14: The system of Implementation #13 further comprising: one or more bias components to maintain the variable cone in the disengaged state.

Implementation #15: The system of any one or more of Implementation #10-14, wherein the one or more wedge segments and the one or more circular segments are configured in an alternating circular pattern to form the variable cone.

Implementation #16: A method comprising: disposing a cone system into an expandable liner hanger positioned in a wellbore, wherein the cone system comprises a variable cone and a tapered mandrel; axially translating the variable cone along the tapered mandrel in a first direction to radially expand the variable cone to an assembled state; expanding the expandable liner hanger via the variable cone in the assembled state; and removing the cone system from the wellbore.

Implementation #17: The method of Implementation #16 further comprising: applying a force to the tapered mandrel to axially translate the variable cone in the first direction.

Implementation #18: The method of Implementation #16 or #17 further comprising: axially translating the variable cone along the tapered mandrel in a second direction that is opposite the first direction to radially contract the variable cone to a disengaged state; and removing the cone system from the wellbore with the variable cone in the disengaged state.

Implementation #19: The method of Implementation #18, wherein the variable cone is configured with one or more wedge segments and one or more circular segments configured to radially expand and radially contract when axially translated along the tapered mandrel.

Implementation #20: The method of any one or more of Implementation #16-19, wherein the variable cone contacts a hanger launching region of the expandable liner hanger when in the assembled state to expand the expandable liner hanger.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

The invention claimed is:

1. An apparatus for expanding an expandable liner hanger comprising:

a variable cone comprising one or more wedge segments and one or more circular segments, wherein the one or more wedge segments and the one or more circular segments are configured to radially expand or contract together upon axial translation along a tapered mandrel, and wherein the one or more wedge segments and the one or more circular segments are configured to collectively engage the expandable liner hanger as a composite cone structure when radially expanded.

2. The apparatus of claim 1, wherein the one or more wedge segments and the one or more circular segments are configured with one or more channels to maintain a respective circumferential position with respect to the tapered mandrel, and wherein the tapered mandrel includes one or more insert components to fit inside the respective channels.

3. The apparatus of claim 1, wherein the tapered mandrel is configured with one or more channels, and wherein the one or more wedge segments and the one or more circular segments are configured with one or more insert components to fit inside the respective channels to maintain a respective circumferential position with respect to the tapered mandrel.

4. The apparatus of claim 1, wherein the one or more wedge segments and the one or more circular segments radially expand to an assembled state when the variable cone axially translates along the tapered mandrel in a first direction.

5. The apparatus of claim 4, wherein the variable cone contacts a hanger launching region of the expandable liner hanger when in the assembled state to expand the expandable liner hanger.

6. The apparatus of claim 4, wherein the one or more wedge segments and the one or more circular segments radially contract to a disengaged state when the variable cone axially translates along the tapered mandrel in a second direction that is opposite the first direction.

7. The apparatus of claim 6 further comprising:

one or more bias components to maintain the variable cone in the disengaged state.

8. The apparatus of claim 1, wherein the one or more wedge segments and the one or more circular segments are configured in an alternating circular pattern to form the variable cone.

9. The apparatus of claim 1 further comprising:

a solid cone, wherein the solid cone applies a force to the variable cone to radially expand the variable cone.

10. A system comprising:

a tapered mandrel; and a variable cone comprising a one or more wedge segments and a one or more circular segments configured to radially expand or contract together upon axial translation along the tapered mandrel, and wherein the one or more wedge segments and the one or more circular segments are configured to collectively engage an expandable liner hanger as a composite cone structure when radially expanded.

11. The system of claim 10, wherein the one or more wedge segments and the one or more circular segments radially expand to an assembled state when the variable cone axially translates along the tapered mandrel in a first direction.

12. The system of claim 11, wherein the variable cone contacts a hanger launching region of the expandable liner hanger when in the assembled state to expand the expandable liner hanger.

13. The system of claim 11, wherein the one or more wedge segments and the one or more circular segments radially contract to a disengaged state when the variable cone axially translates along the tapered mandrel in a second direction that is opposite the first direction.

14. The system of claim 13 further comprising:

one or more bias components to maintain the variable cone in the disengaged state.

15. The system of claim 10, wherein the one or more wedge segments and the one or more circular segments are configured in an alternating circular pattern to form the variable cone.

16. A method comprising:

disposing a cone system into an expandable liner hanger positioned in a wellbore, wherein the cone system comprises a variable cone and a tapered mandrel, and wherein the variable cone comprises one or more wedge segments and one or more circular segments;

axially translating the variable cone along the tapered mandrel in a first direction to radially expand the variable cone to an assembled state, wherein the one or more wedge segments and the one or more circular segments radially expand together upon the axially translating of the variable cone along the tapered mandrel;

expanding the expandable liner hanger via the variable cone in the assembled state, wherein, in the assembled state, the one or more wedge segments and the one or more circular segments of the variable cone are configured to collectively engage the expandable liner hanger as a composite cone structure; and removing the cone system from the wellbore.

17. The method of claim 16 further comprising:

applying a force to the tapered mandrel to axially translate the variable cone in the first direction.

18. The method of claim 16 further comprising:

axially translating the variable cone along the tapered mandrel in a second direction that is opposite the first direction to radially contract the variable cone to a disengaged state; and removing the cone system from the wellbore with the variable cone in the disengaged state.

19. The method of claim 18, wherein the one or more wedge segments and the one or more circular segments configured to radially contract together when axially translated along the tapered mandrel in the second direction.

20. The method of claim 16, wherein the variable cone contacts a hanger launching region of the expandable liner hanger when in the assembled state to expand the expandable liner hanger.

* * * * *